United States Patent [19]

Shimomura et al.

[11] Patent Number: 4,665,871

[45] Date of Patent: May 19, 1987

[54] RPM CONTROL APPARATUS FOR INTERNAL COMBUSTION ENGINE

[75] Inventors: Setsuhiro Shimomura; Yukinobu Nishimura, both of Himeji, Japan

[73] Assignee: Mitsubishi Denki Kabushiki Kaisha, Tokyo, Japan

[21] Appl. No.: 843,751

[22] Filed: Mar. 25, 1986

[30] Foreign Application Priority Data

Apr. 2, 1985 [JP] Japan ..... 60-71519

[51] Int. Cl.[4] ..... F02D 33/02

[52] U.S. Cl. ..... 123/352

[58] Field of Search ..... 123/339, 352

[56] References Cited

U.S. PATENT DOCUMENTS

| | | | |
|---|---|---|---|
| 4,321,901 | 3/1982 | Kobayashi et al. | 123/352 |
| 4,398,514 | 8/1983 | Nakamura | 123/339 |
| 4,461,253 | 7/1984 | Kobashi et al. | 123/352 X |
| 4,501,240 | 2/1985 | Aono | 123/352 X |
| 4,506,639 | 3/1985 | Murakami et al. | 123/339 |
| 4,577,603 | 3/1986 | Murakami et al. | 123/339 |

FOREIGN PATENT DOCUMENTS

| | | |
|---|---|---|
| 59-162340 | 9/1984 | Japan . |
| 2056125 | 3/1981 | United Kingdom . |
| 2109592 | 6/1983 | United Kingdom . |
| 2128779 | 5/1984 | United Kingdom . |

*Primary Examiner*—Willis R. Wolfe, Jr.

*Attorney, Agent, or Firm*—Leydig, Voit & Mayer

[57] ABSTRACT

An RPM control apparatus for an internal combustion engine capable of stopping the operation of an RPM adjuster which generates an RPM feedback control signal indicating a target suction quantity signal or a target suction pipe pressure signal for the engine in relation to the RPM of the engine and a target RPM thereof, and/or the operation of a suction adjuster which generates a suction feedback control signal in relation to the output of the RPM adjuster and an actual suction quantity or an actual suction pipe pressure of the engine, when at least one of the output of the adjusters exceeds a corresponding predetermined value.

3 Claims, 1 Drawing Figure

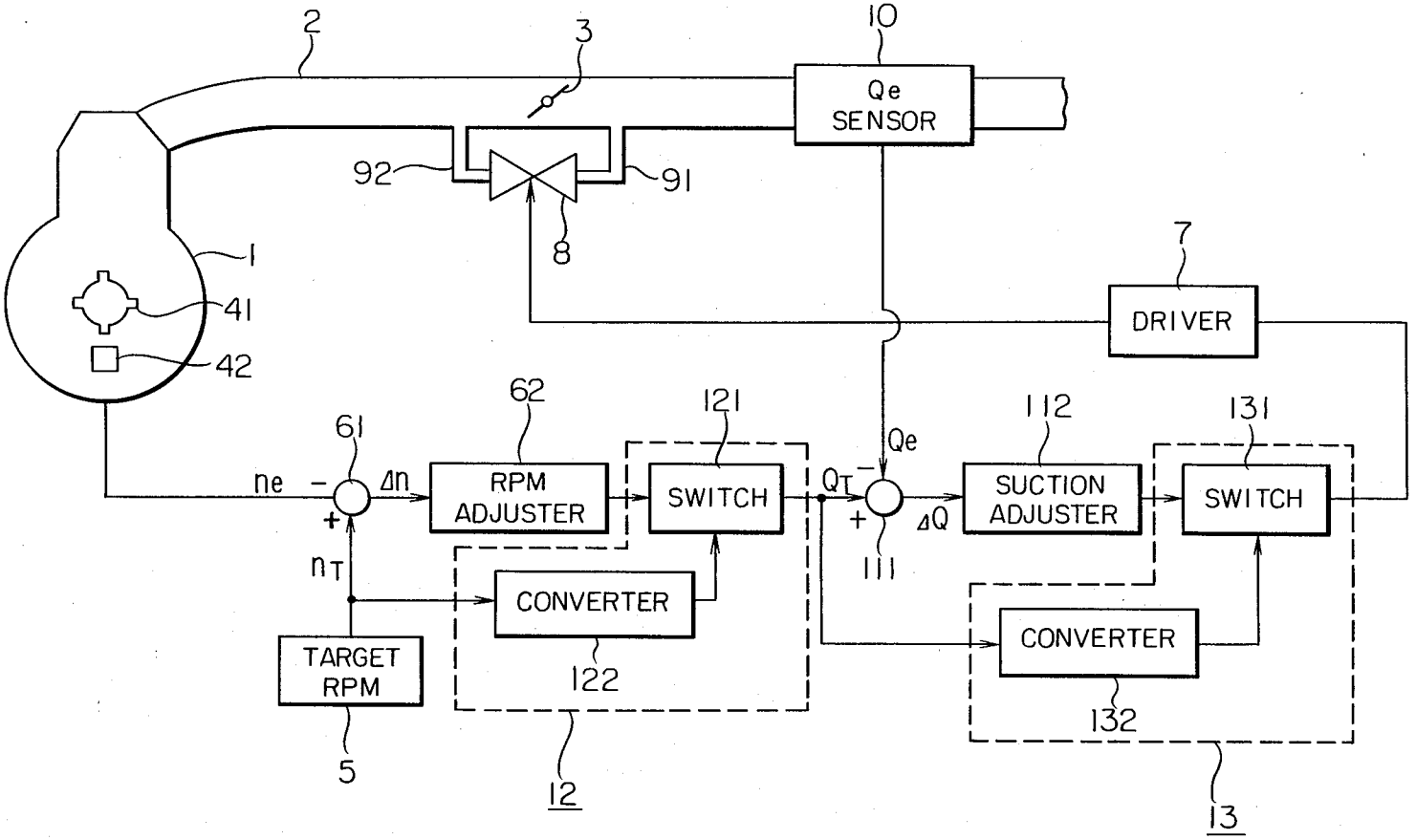
Qe SENSOR
10
DRIVER
7
SWITCH
131
SUCTION ADJUSTER
112
CONVERTER
132
13
Qe
ΔQ
111
QT
SWITCH
121
RPM ADJUSTER
62
CONVERTER
122
12
91
8
3
92
2
1
41
42
Δn
61
ne
nT
TARGET RPM
5

RPM CONTROL APPARATUS FOR INTERNAL COMBUSTION ENGINE

BACKGROUND OF THE INVENTION

This invention relates to an apparatus for controlling the revolutions (hereinafter referred to as RPM) of an internal combustion engine which serves to feedback-control a no-load RPM of the internal combustion engine to a predetermined RPM.

Heretofore, such a no-load RPM of an internal combustion engine has been subjected to a constant-value control to a predetermined RPM. The purposes of this RPM control are to set the no-load RPM small so as to suppress the fuel economy in a no-load mode as far as possible, and to suppress the fluctuation of the RPM ascribable to disturbance, so that a rapid controllability of high precision is required.

Factors for the fluctuations of the RPM are broadly classified into a a primary factor attributed to the fluctuation of a no-load loss of the engine itself and/or to the fluctuation of the thermal efficiency of the engine, and a secondary factor attributed to the fluctuation of an adjustment gain inherent in a suction adjustment means employed for adjusting the RPM fluctuation caused by the primary factor and/or to the fluctuation of the density of the atmospheric air forming an air suction source.

As disclosed in the Official Gazette of Japanese Patent Application Laid-open No. 59-162340, accordingly, there has been proposed a method of controlling the RPM of the engine to a target value by generating a target suction quantity or suction pipe pressure in accordance with an adjustment signal based on the deviation between the target value and actual value of the RPM and controlling the suction adjustment means in accordance with an adjustment signal based on the deviation between the generated target and an actual suction quantity or suction pipe pressure.

According to this method, the adjustment signal (RPM adjustment signal) based on the deviation between the target value and actual value of the RPM attends to the primary factor of the RPM fluctuation, while the adjustment signal (suction adjustment signal) based on the deviation between the target value and actual value of the suction quantity or the suction pipe pressure separately attends to the secondary factor. It is therefore clear that the RPM fluctuations can be adjusted with higher precision and at higher speed than in the case of a feedback control based on only the RPM.

The above construction, however, has a major disadvantage to be stated below: When a failure has taken place upon either the detection of the RPM or the detection of the suction quantity, the corresponding adjustment signal responds limitlessly to cause the engine to run away or stop abnormally and to fall into an unfavorable situation.

SUMMARY OF THE INVENTION

This invention has been made in order to solve such a problem, and has for its object to provide an RPM control apparatus for an internal combustion engine by which any useless fluctuation of the RPM of the engine is prevented from arising even in a transient state, and by which even in case of a failure, the adjustment of the RPM is limited so that the engine can be prevented from falling into the worst situation of runaway or stoppage.

The RPM control apparatus for an internal combustion engine according to this invention broadly comprises means for stopping the operation of at least one of an RPM adjuster which generates a target suction quantity signal or a target suction pipe pressure signal for the engine is relation to the RPM of the engine and a target RPM thereof and a suction adjuster which generates an adjustment signal in relation to the output of the RPM adjuster and an actual suction quantity or an actual suction pipe pressure of the engine when the output of the RPM adjuster or the output of the suction adjuster exceeds a predetermined value.

In this invention, when the target suction quantity or target suction pressure of the engine generated by the RPM adjuster exceeds a predetermined value or when an adjustment signal delivered from the suction adjuster exceeds a predetermined value, the operation of at least one of the RPM adjuster and the suction adjuster is stopped, whereupon the RPM of the engine is settled to a target value.

BRIEF DESCRIPTION OF THE DRAWING

The single FIGURE is a block diagram showing the arrangement of one embodiment of an RPM control apparatus for an internal combustion engine according to this invention.

DETAILED DESCRIPTION OF THE PREFERRED EMBODIMENT

Now, an embodiment of an RPM control apparatus for an internal combustion engine according to this invention will be described with reference to the accompanying drawing.

The single FIGURE is a block diagram showing the arrangement of the embodiment, wherein a reference numeral 1 in the FIGURE designates an internal combustion engine, and a reference numeral 2 designates a suction pipe in which a throttle valve 3 for controlling the RPM of the engine in correspondence with the load thereof is disposed.

The suction pipe 2 is provided with bypass passages 91 and 92 at parts before and behind the throttle valve 3, and a suction control valve 8 is interposed between the bypass passages 91 and 92. The suction control valve 8 may comprise a linear solenoid valve, a D.C. motor-controlled valve or the like, and it is driven and controlled by the output of a driver 7.

On the other hand, the internal combustion engine 1 is provided with a gear 41 which interlocks with the rotation of the engine 1. The rotation of the gear 41 is detected by an RPM sensor 42, to send an engine RPM signal $n_e$ to an error amplifier 61.

This error amplifier 61 is also supplied with a target RPM signal $n_T$ from a target RPM generator 5. The target RPM generator 5 generates the target RPM signal $n_T$ of a target no-load RPM in correspondence with various conditions of an engine temperature etc.

The error amplifier 61 calculates the error $\Delta n$ between the target RPM signal $n_T$ and the engine RPM signal $n_e$ of the RPM sensor 42, and this error $\Delta n$ is sent to an RPM adjuster 62.

Upon receiving the error $\Delta n$, the RPM adjuster 62 generates an RPM adjustment signal so as to decrease the error $\Delta n$ owing to a proportional, integral or differential operation, and delivers the signal to a switch 121.

In addition, the target RPM signal $n_T$ generated by the target RPM generator 5 is input to a converter 122. This converter 122 is adapted to generate a standard suction quantity required for a standard engine to hold the target RPM in accordance with the target RPM signal $n_T$. An RPM adjustment stopper 12 is constructed of the converter 122 and the switch 121. This RPM adjustment stopper 12 functions to stop the operation of the RPM adjuster 62.

A target suction quantity $Q_T$ of an engine suction quantity is delivered from the switch 121 to an error amplifier 111, and is applied to a converter 132 of a suction adjustment stopper 13.

The error amplifier 111 is also supplied with output $Q_e$ of a suction quantity sensor 10. This suction quantity sensor 10 is mounted on the suction pipe 2, and detects the quantity of suction air which is imbibed into the internal combustion engine 1 through the suction pipe 2.

Further, the error amplifier 111 sends a suction adjuster 112 the error $\Delta Q$ between the output $Q_e$ of the suction quantity sensor 10 and the output of the switch 121, namely, the target suction quantity $Q_T$. Upon receiving the error $\Delta Q$, the suction adjuster 112 generates a suction adjustment signal so as to decrease the error $\Delta Q$ owing to a proportional, integral or differential operation, and it sends the signal to a switch 131.

This switch 131 is supplied with the output of the converter 132. The output of the converter 132 is delivered to the driver 7. The suction adjustment stopper 13 is constructed of the converter 132 and the switch 131.

Next, the operation of the RPM control apparatus for an internal combustion engine according to this invention constructed as thus far described will be explained.

On the basis of the RPM error $\Delta n$, the RPM adjuster 62 is actuated to generate an output. Since this output is generated so as to decrease the error $\Delta n$, the RPM is settled or stabilized when the error $\Delta n$ is minimized.

The output of the RPM adjuster 62 is applied to the switch 121 forming the RPM adjustment stopper 12. The switch 121 compares the output of the RPM adjuster 62 with a limit value, and passes therethrough the former when it is smaller than the limit value. When the output of the RPM adjuster 62 is greater than the limit value, the switch 121 blocks the former and passes therethrough a value generated by the converter 122 in accordance with the target RPM $n_T$, that is, a standard suction quantity required for a standard engine to hold the target RPM.

The output of the switch 121 forms the target value $Q_T$ of the engine suction quantity, and its error $\Delta Q$ with respect to the output $Q_e$ of the suction quantity sensor 10 is calculated by the error amplifier 111. The error $\Delta Q$ of the suction quantity actuates the suction adjuster 112 to generate an output. Since this output is generated so as to decrease the error $\Delta Q$, the suction quantity is settled when the error $\Delta Q$ is minimized.

The output of the suction adjuster 112 is applied to the switch 131. This switch 131 compares the output of the suction adjuster 112 with a limit value, and passes therethrough the former when it is smaller than the limit value. When the output of the suction adjuster 112 is greater than the limit value, the switch 131 blocks the former and passes therethrough value generated by the converter 132 in accordance with the target suction quantity $Q_T$, that is, a standard adjustment value required for a standard suction control system to hold a target suction quantity.

The output of the switch 131 is converted into an electric signal by the driver 7. This electric signal is used for driving the suction control valve 8.

The suction control valve 8 operates so as to have an opening area corresponding to the electric signal. This valve may comprise a solenoid valve whose position changes in proportion to an input voltage, a D.C. motorcontrolled valve whose position changes in proportion to a conduction time, or the like.

Air with flow rate corresponding to the opening area of the suction control valve 8 flows through the bypasses 91 and 92, and the flow rate of air to be sucked in the internal combustion engine 1 is increased or decreased.

Thus, the RPM of the internal combustion engine 1 is settled to the target value. At this time, the suction quantity is also settled to the target value. The suction adjustment signal in this settled state adjusts the error $\Delta Q$ to the minimum. That is, the suction adjustment signal adjusts errors inherent in various factors for adjusting the suction quantity, such as dispersion of leakage air quantity of the throttle valve 3 at the no-load position thereof, characteristic fluctuations due to an initial characteristic error of the suction control valve 8 and temperatures etc., the supply voltage-dependency of the driver 7, and/or the dependency of gains on the density of the atmospheric air.

The switch 131 has a proper limit value set in correspondence with a value into which these errors inherent in the above factors for adjusting the suction quantity are approximately cumulated.

Accordingly, even when the suction adjustment signal is diverged in a case where the suction quantity $Q_e$ can not be fedback due to the malfunction of the suction quantity sensor 10, the adjustment signal is changed-over to the standard adjustment value by the switch 131, and the divergence of the suction quantity is prevented. Therefore, the divergence (runaway or stoppage) of the engine RPM is prevented.

Next, the RPM adjustment signal adjusts the target suction quantity $Q_T$ so as to adjust the error $\Delta n$ to the minimum to bring the engine RPM $n_e$ into substantial agreement with the target RPM $n_T$. This is because the RPM adjustment signal adjusts the dispersion of the losses at various parts of the engine and the fluctuation of the thermal efficiency of the engine, and/or load fluctuations ascribable to various installations including lamps, motors etc. as observed in the case of an internal combustion engine for automobiles, etc.

The switch 121 has a proper limit value set in correspondence with a value into which these errors attributed to the losses of various parts of the engine and the load fluctuations are approximately cumulated. Accordingly, even when the RPM adjustment signal is diverged in a case where the RPM can not be fedback due to the malfunction of the RPM sensor 42 or any other element, the adjustment signal is changed-over to the standard suction quantity by the switch 121, and the target value of the suction quantity does not diverge. Therefore, the divergence (runaway or stop) of the engine RPM is prevented.

In the above embodiment, as soon as the adjustment value has exceeded the limit value, it is changed-over to the standard value. However, if the RPM adjuster 62 or the suction adjuster 112 is given an adjustment gain so as to compensate for the response delays of various parts of the engine and the control apparatus most suitably, an excessive adjustment may arise in some cases.

If the switch 121 or 131 is so constructed as to delay the change-over in correspondence with such an excessive adjustment such that the adjustment value is prevented from being changed-over to the standard value due to such an excessive adjustment, a more preferable RPM control system is provided.

Besides, if the apparatus is endowed with the function of issuing an alarm upon the operation of the switch 121 or 131, favorably the part of the malfunction of any of the suction quantity sensor, the RPM sensor, the suction control valve etc. forming the RPM control system can be readily detected.

In the illustrated embodiment explained above, the adjustment signal is generated on the basis of only the difference between the target value and the actual value. However, it is also possible to generate the adjustment signal by combining a term proportional to the target value and a term based on the difference between the target value and the actual value.

For enhancing the effect of this invention, it is preferable that the adjustment speed of the suction adjuster 112 is higher than the adjustment speed of the revolution number adjuster 62. Therefore, the proportional, integral or differential adjustment gain of the suction adjuster 112 should preferably be set higher than that of the RPM adjuster 62.

Moreover, in order to achieve a similar effect, the limit value of the switch 131 or 121 can be increased or decreased in the transient state of the adjusting operation.

While the suction quantity sensor 10 is employed in the illustrated embodiment, it is needless to say that a similar effect is achieved even when a suction pipe pressure sensor disposed downstream of the throttle valve 3 is used instead.

Further, while, in the illustrated embodiment, the operation of the adjuster is stopped in case of a malfunction, the suction control valve continues to be driven with the standard value previously estimated.

However, in a case where the suction control valve is stopped, the standard value can also be determined to a value adapted to stop the suction control valve.

As described above, this invention consists in that the factors of RPM fluctuations are separated into one based on the loss of an engine and the other based on suction quantity adjustment means, and that the control ranges of an RPM adjuster and a suction adjuster are limited in accordance with the respective factors in a necessary and sufficient manner. It is therefore possible to prevent the situation of the runaway or stop of the engine attributed to the fact that an adjusting operation is limitlessly performed in case of the malfunction or failure of any of various sensors etc.

What is claimed is:

1. An RPM control apparatus for an internal combustion engine comprising:

an RPM adjuster which generates at least one of a target suction quantity signal and a target suction pipe pressure signal for the engine in relation to the RPM of the engine and a target RPM thereof;

a suction adjuster which generates an adjustment signal in relation to the output of said RPM adjuster and at least one of an actual suction quantity and an actual suction pipe pressure of the engine;

a suction control valve which receives the output of said suction adjuster; and means for stopping the operation of at least one of said RPM adjuster and said suction adjuster when at least one of the output of said RPM adjuster and the output of said suction adjuster has exceeded a corresponding predetermined value.

2. An RPM control apparatus for an internal combustion engine as claimed in claim 1, wherein said means includes an RPM adjustment stopper having a switch which passes therethrough the output of said RPM adjuster when said output is smaller than said corresponding predetermined value, and a converter for converting said target RPM into a standard suction quantity necessary for a standard engine to hold said target RPM, said switch passing therethrough the output of said converter when the output of said RPM adjuster is not smaller than said corresponding predetermined value.

3. An RPM control apparatus for an internal combustion engine as claimed in claim 2, wherein said means includes a suction adjustment stopper having a switch which passes therethrough the output of said suction adjuster when said output is smaller than said corresponding predetermined value, and a converter for converting the output of said RPM adjustment stopper into a standard adjustment value necessary for a standard suction system to hold at least one of the target suction quantity and the target suction pipe pressure, said switch passing therethrough the output of said converter when the output of said suction adjuster is not smaller than said corresponding predetermined value.

* * * * *